United States Patent [19]

Musgrave

[11] 4,115,944

[45] Sep. 26, 1978

[54] BALLISTIC CUTTERS

[76] Inventor: Daniel D. Musgrave, 8201 Caraway St., Cabin John, Md. 20731

[21] Appl. No.: 854,819

[22] Filed: Nov. 25, 1977

[51] Int. Cl.[2] ..... F41C 27/00

[52] U.S. Cl. ..... 42/90

[58] Field of Search ..... 42/90

[56] References Cited

U.S. PATENT DOCUMENTS

| | | | |
|---|---|---|---|
| Re. 28,146 | 9/1974 | Musgrave | 42/90 |
| 1,211,779 | 1/1917 | Steinmetz | 42/90 |
| 3,879,878 | 4/1975 | Musgrave | 42/90 |
| 3,913,252 | 10/1975 | Musgrave | 42/90 |
| 3,950,877 | 4/1976 | Musgrave | 42/90 |
| 3,950,878 | 4/1976 | Musgrave | 42/90 |

*Primary Examiner*—Charles T. Jordan

[57] ABSTRACT

Improvements in ballistic cutters used at the muzzle of a firearm for cutting obstacle, or other material. An arrangement is shown whereby a cutter is useable with more than one model of firearm. Improved means are disclosed for engaging a strand to be cut. The use of color on the engagement members is disclosed as an aid to engaging the obstacle.

5 Claims, 6 Drawing Figures

BALLISTIC CUTTERS

Recent improvements in military field obstacles have generated interest in ways of defeating them. Ordinary barbed wire has now been replaced to a considerable extent by several forms of barbed tape. The common hand-operated wire cutters are relatively ineffective against the newer materials and, in combat, such wire cutters are not always available. Ballistic cutters can be made small and simple, so as to always accompany the user, who would ordinarily be the Infantry rifleman. Cutting with ballistic cutters is accomplished by the energy of an exploding cartridge, thus saving the user from fatigue.

Although the number of different models of military rifles in use at present is small compared to a generation ago, current types vary considerably in detail. But one feature which has been standardized in many countries is the diameter of the muzzle device, which normally is a flash suppressor. The purpose of the standard diameter is to permit launching rifle grenades, which usually are manufactured with a standard interior tail diameter.

Furthermore, such muzzle devices frequently are made with longitudinal slots therein. As a result there is a noticeable resemblance amoung the muzzle portions of several well-known modern military rifles.

A typical ballistic cutter is disclosed in U.S. Pat. No. Re. 28,146. Experience with this type of cutter has shown that under adverse conditions, such as poor light, there is some difficulty in engaging individual strands when cutting a complex obstacle.

In consideration of the above-described situation, it is an object of this invention to provide a ballistic cutter which is useable with more than one model of firearm.

Another object is to provide a ballistic cutter having means to facilitate engaging an object to be cut.

These and other objects of the present invention will become apparent upon consideration of the following description taken in conjunction with the accompanying drawings, wherein.

In the above description of the drawings, the words "side" and "top" are used only to properly relate the several views to each other. As will be explained below, the device can be installed on a firearm in several possible orientations, so the designations side and top are arbitrary.

Figure 1:
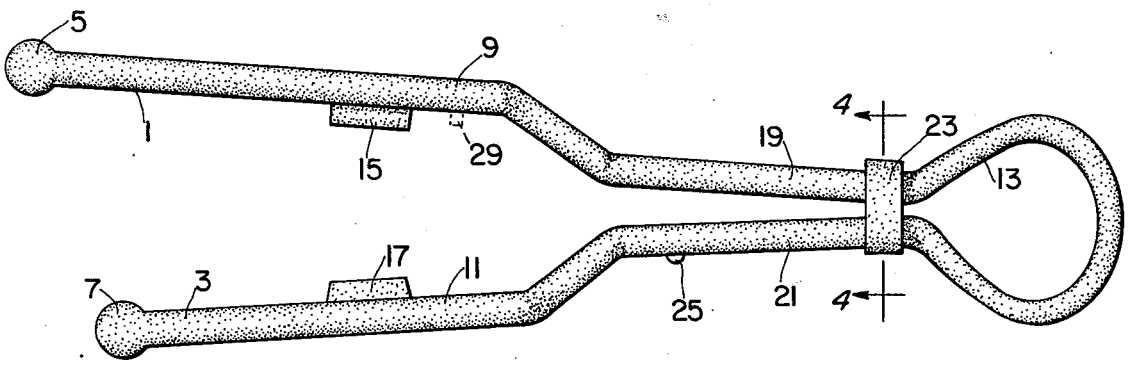
FIG. 1 is a side view of a ballistic cutter which is an embodiment of this invention.

Referring to the drawings, FIG. 1 shows a ballistic cutter, the cutter being shown not attached to a firearm. The cutter has a pair of windlassing lugs 1 and 3 which include enlarged portions 5 and 7 at their respective extremities. The enlarged portions are shown in FIG. 1 as spheres, but other shapes may be employed as will be explained hereinafter.

Windlassing lugs 1 and 3 extend from a pair of bent members 9 and 11 respectively, which members are connected by a resillient loop 13, of any suitable material. The lugs, bent members and loop may be made of a single piece of material, or they may be made separately and joined together by any suitable method.

Wedges are affixed to each bent member by any suitable method. Wedge 15 is affixed to member 9 and wedge 17 is affixed to member 11.

The portions of the bent members near the loop are numbered 19 and 21 respectively. It will be noted that they converge slightly as they approach the loop.

Figure 2:
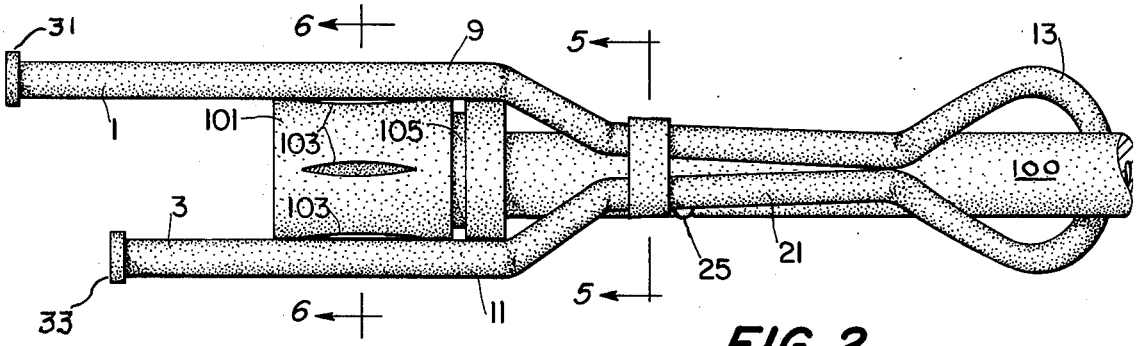
FIG. 2 is a side view of a ballistic cutter slightly different from tht shown in FIG. 1 and affixed to the muzzle of a firearm.

Encompassing portions 19 and 21 is link 23, which in FIG. 1, is positioned at the point where portions 19 and 21 are close together. The link is adapted to slide on the said portions and may be positioned as shown in FIG. 2, where it has acted against the diverging portions and thereby moved lugs 1 and 3 toward each other. To keep the link in this position, a small raised detent 25 may be formed on portion 21.

In FIG. 2, the resilience of loop 13, which is tending to spread members 19 and 21, is thus keeping detent 25 engaged with link 23. The link may be made of any suitable material, such as one of the common metals. In FIG. 2, the ballistic cutter bas been installed on the muzzle portion of a firearm having a barrel 100 and a flash suppressor 101 fixed on said barrel in the usual manner. The suppressor has a plurality of longitudinal slots 103 through which part of the muzzle blast passes when a shot is fired. It also has a radial groove 105 to provide increased cooling surface in the area where the barrel and suppressor make contact. In actual practice the number, size, and shape of said slots and grooves may vary in different models of firearms, and the arrangement illustrated should only be considered exemplary of current practice.

Figure 3:
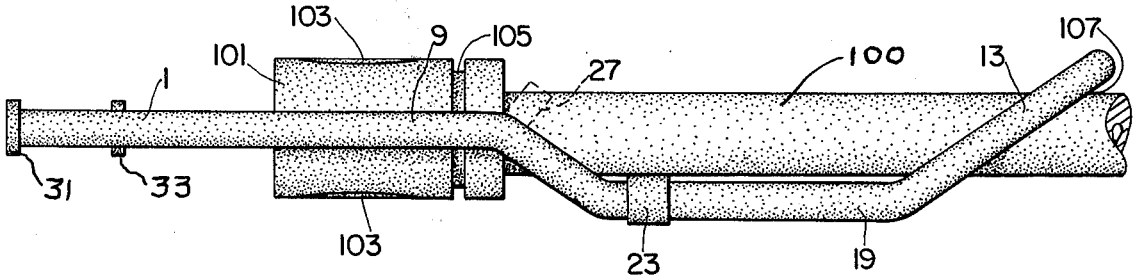
FIG. 3 is a top view of the cutter and muzzle shown in FIG. 2.
Figure 4:
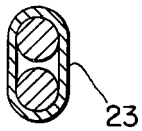
FIG. 4 is a cross-section taken in the plane indicated by line 4—4 on FIG. 1.

By comparing FIGS. 2 and 3, it will be seen that loop 13 is encompassing barrel 100. To permit the cutter to be installed on and removed from a firearm having a muzzle device, such as for example suppressor 101, the interior diameter of the loop must be so chosen that said muzzle device can pass through said loop. By forming the loop at an angle relative to the longitudinal axis of the ballistic cutter, it can rest lightly against the barrel when installed on the firearm. This is indicated by numeral 107 in FIG. 3.

When the cutter is installed, the loop is passed back over suppressor 101 and pivoted generally on the loop so as to bring lugs 1 and 3 substantially in line with the longitudinal axis of barrel 100. The lugs are then moved toward each other with each wedge, 15 and 17, entering a slot 103 on the flash suppressor. When members 9 and 11 are in substantial contact with suppressor 101, link 23 is moved to the position shown in FIGS. 2 and 3. The link will be retained in this position by detent 25. The detent will be kept in engagement with the link by the resilience of loop 13 acting via members 19 and 21.

Figure 5:
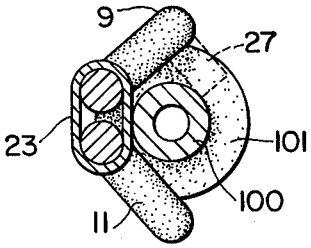
FIG. 5 is a cross-section taken in the plane indicated by line 5—5 on FIG. 2.
Figure 6:
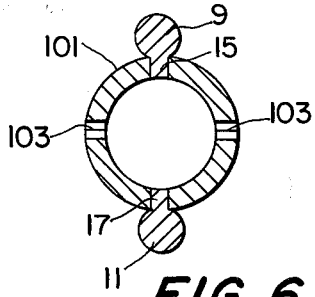
FIG. 6 is a cross-section taken in the plane indicated by line 6—6 on FIG. 2.

When the cutter is so installed, it will be noted in FIGS. 2 and 3 that the link is disposed as to rest along one side of barrel 100, and thus provide some support for the cutter. On the opposite side of the barrel somewhat similar support can be provided by a stud 27, protruding down from member 9 in FIG. 5, and lightly contacting barrel 100. The stud is drawn in broken lines to indicate that it is an optional feature. Another optional feature is a projection 29, shown in FIG. 1. It could be shaped, dimensioned and positoned so as to engage groove 105 when the cutter is installed on a firearm as in FIGS. 2 and 3. It would thus be capable of preventing relative longitudinal motion between the cutter and the firearm, if for example, the relationship of the wedges with the slots could not properly assure this.

Loop 13 is shown as an incomplete circle. If desired it could be made as a complete loop and a portion of a loop, with members 19 and 21 disposed substantially as shown in FIGS. 1, 2, and 3.

It will be noticed in FIGS. 2 and 3 that lugs 1 and 3 have at their ends cylindrical portions 31 and 33 respectively. The cylindrical portions are slightly greater in diameter than the lugs. In operation, portion 31 on the long lug is used to feel for a strand of material to be cut. When the strand is thus engaged, the firearm with the ballistic cutter mounted, is moved toward the strand thus positioning it between lugs 1 and 3. The firearm is then rotated about its longitudinal axis thereby aligning the strand with the bore of the firearm in the known manner. During such rotation lug 33 will keep the strand engaged with the lugs. A shot can then be discharged to sever the strand.

Enlarged portions 5 and 7 in FIG. 1 would be used in the same manner, they being disclosed merely as an alternate construction.

To assist in engaging the strand under conditions of poor visibility, lugs 1 and 3 can be given a highly visible coloration. To further assist under said conditions, each lug can have a different color.

To permit a ballistic cutter such as that shown in FIG. 1 to be used with more than one model of firearm, the shape and dimensions of wedges 15 and 17 can be so chosen that they can enter dissimilar slots on muzzle devices on different firearms.

Such slots are disposed radially around such devices. The cutter can therefore be installed in several possible radial relationships with the firearm. This is an advantage as it permits each user to install the cutter at the angle he finds most convenient for cutting.

There is thus disclosed a cutter which can be used with various firearms. It is desired to emphasize that the disclosure is exemplary, and that the improvements described and claimed can be used with ballistic cutters differing from the example illustrated.

What I claim is:

1. A ballistic cutter comprising: means adapted for engagement with a barrel of a firearm near a muzzle thereof; a pair of members extending from said means, each of said pair terminating in a windlassing lug; wedge means on each of said pair positionally adapted for engagement with a slot in a device affixed to said muzzle; and means for retaining said wedge means in said engagement whereby said cutter can be mounted with each said lug protruding beyond said device.

2. A ballistic cutter as set forth in claim 1 wherein said means adapted for engagement with a barrel is resilient.

3. A ballistic cutter as set forth in claim 1 wherein each said lug is adapted to protrude a different distance beyond said device.

4. A ballistic cutter as set forth in claim 1 wherein said wedge means is adapted to engage dissimilar slots on various devices affixed to firearms muzzles.

5. A ballistic cutter as set forth in claim 1 which can be mounted near a muzzle of a firearm in several possible radial relationships with said firearm.

* * * * *